US005676251A

United States Patent [19]

Credle, Jr.

[11] Patent Number: 5,676,251

[45] Date of Patent: Oct. 14, 1997

[54] FOOD SERVICE KIT AND METHOD FOR USING

[75] Inventor: William S. Credle, Jr., Stone Mountain, Ga.

[73] Assignee: The Coca-Cola Company, Atlanta, Ga.

[21] Appl. No.: 702,166

[22] Filed: Aug. 23, 1996

Related U.S. Application Data

[63] Continuation of Ser. No. 386,878, Feb. 10, 1995, abandoned, which is a continuation-in-part of Ser. No. 27,425, Aug. 22, 1994, Pat. No. Des. 371,281.

[51] Int. Cl.[6] ..... B65D 21/032

[52] U.S. Cl. ..... 206/501; 220/23.83; 220/23.6; 206/541

[58] Field of Search ..... 220/23.4, 23.6, 220/23.83, 23.86; 206/508, 509, 511, 541, 543, 544, 547, 501; 446/73, 74, 75, 76, 77, 128, 120, 121

[56] References Cited

U.S. PATENT DOCUMENTS

| | | | |
|---|---|---|---|
| D. 252,908 | 9/1979 | Bayly . | |
| D. 252,909 | 9/1979 | Bayly . | |
| D. 252,910 | 9/1979 | Bayly . | |
| D. 252,977 | 9/1979 | Bayly . | |
| D. 252,978 | 9/1979 | Bayly . | |
| D. 252,979 | 9/1979 | Bayly . | |
| D. 252,980 | 9/1979 | Bayly . | |
| D. 252,981 | 9/1979 | Fenton . | |
| D. 322,938 | 1/1992 | Baroi . | |
| D. 333,978 | 3/1993 | Zutler . | |
| 1,771,264 | 7/1930 | Marrits . | |
| 2,631,747 | 3/1953 | Stolte . | |
| 3,374,917 | 3/1968 | Troy . | |
| 3,422,564 | 1/1969 | Izumi . | |
| 3,595,425 | 7/1971 | Eicholtz et al. | 220/23.6 |
| 3,616,943 | 11/1971 | Brink . | |
| 3,640,018 | 2/1972 | Light . | |
| 3,648,830 | 3/1972 | Graf | 206/544 |
| 3,815,281 | 6/1974 | Kander . | |
| 4,076,123 | 2/1978 | Davis . | |
| 4,120,396 | 10/1978 | Mascia et al. . | |
| 4,582,447 | 4/1986 | Itoh . | |
| 4,656,840 | 4/1987 | Loofbourrow et al. . | |
| 4,844,263 | 7/1989 | Hadtke | 220/23.6 |
| 5,035,324 | 7/1991 | Bertrand | 206/509 |
| 5,056,424 | 10/1991 | Lai | 206/547 |
| 5,069,344 | 12/1991 | Dehart | 206/509 |
| 5,346,309 | 9/1994 | Book | 206/547 |

OTHER PUBLICATIONS

Popular Science—p. 20—Aug. 1992.

*Primary Examiner*—Stephen J. Castellano

*Attorney, Agent, or Firm*—Birch, Stewart, Kolasch and Birch, LLP

[57] ABSTRACT

A food-service kit and method includes a plurality of similar or diverse-type containers wherein the containers may be coupled together in various configurations to form toy-like assemblies. The respective containers include compatible projection and socket configurations so that they may be joined together as building blocks in order to create the toy-like devices.

17 Claims, 8 Drawing Sheets

FOOD SERVICE KIT AND METHOD FOR USING

This application is a continuation of application Ser. No. 08/386,878 filed on Feb. 10, 1995, now abandoned which is a continuation-in part of prior application Ser. No. 29/027,425 filed Aug. 22, 1994, now Pat. No. D371,281, by the same inventor which is entitled "BUILDING BLOCK DRINK CONTAINER" and is commonly assigned.

BACKGROUND OF THE INVENTION

The present invention relates to a food service kit and method for using the same to serve diverse food products and facilitate entertainment of the users by the empty containers remaining after the food has been consumed. More specifically, the present relates to a food-serving kit of diverse-type containers wherein the containers may be coupled together in various configurations to form toy-like assemblies.

It is generally known that empty food containers may be used as building blocks for creating toy-like assemblies from the empty containers. Typically, these food containers are of the same type and multiple units of the same type of containers are fastened together to create the toy-like assemblies. These containers, for example, may have compatible projection and socket assemblies so that the empty containers may be used for building blocks.

Such containers have been effective in promoting multiple sales of the same products, but they have not addressed the need for promoting sales of related families of products in diverse-type containers and the promotion of multiple sales of the products for each of the diverse-type units. Accordingly, a need in the art exists for a food-service kit wherein a plurality of diverse types of food containers may be utilized to serve diverse types of foods, and each of the diverse-type containers has compatible coupling means, so that toy-like assemblies may be created from selected combinations of the diverse type containers.

SUMMARY OF THE INVENTION

Accordingly, it is a primary object of the present invention to provide a food-service kit for serving diverse-type foods in diverse-type containers wherein the respective containers may be coupled together to form a variety of creative toy-like assemblies.

It is another object of the present invention to provide a method of using the food-serving kit of the present invention to serve a meal of a variety of diverse food products wherein empty containers remaining after consumption of the meal may be creatively coupled together to created various toy-like assemblies.

It is still another object of the present invention to provide a food-service kit which is enviromentaly friendly in that each of the containers therein has a secondary use.

It is a further object of the present invention to provide a food-serving kit wherein diverse containers of the kit have an entertainment function when empty as thus promote the sale of the food products associated with the respective containers.

The objects of the present invention are fulfilled by providing a food service kit comprising: at least two diverse types of food containers for serving diverse food products; and each of said at least two containers having like configurations of projections extending therefrom and like configurations of sockets for coupling with the projections of the other of the diverse types of containers; whereby the diverse types of food containers may be coupled together as building blocks to create toy-like assemblies.

The food containers may include beverage containers for carbonated or still beverages, sandwich containers for items such as hamburgers, french fry containers, salad containers and any other type of disposable containers likely to be utilized for serving food in fast-food restaurants.

The containers may be fabricated from styrofoam, paper, polystyrene, and any other types of materials suitable for packaging and serving the related food products.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The objects of the present invention and the attended advantages thereof will become more readily apparent by reference to the drawings wherein like reference numerals refer to like parts and wherein.

DETAILED DESCRIPTION OF PREFERRED EMBODIMENTS

Figure 1:
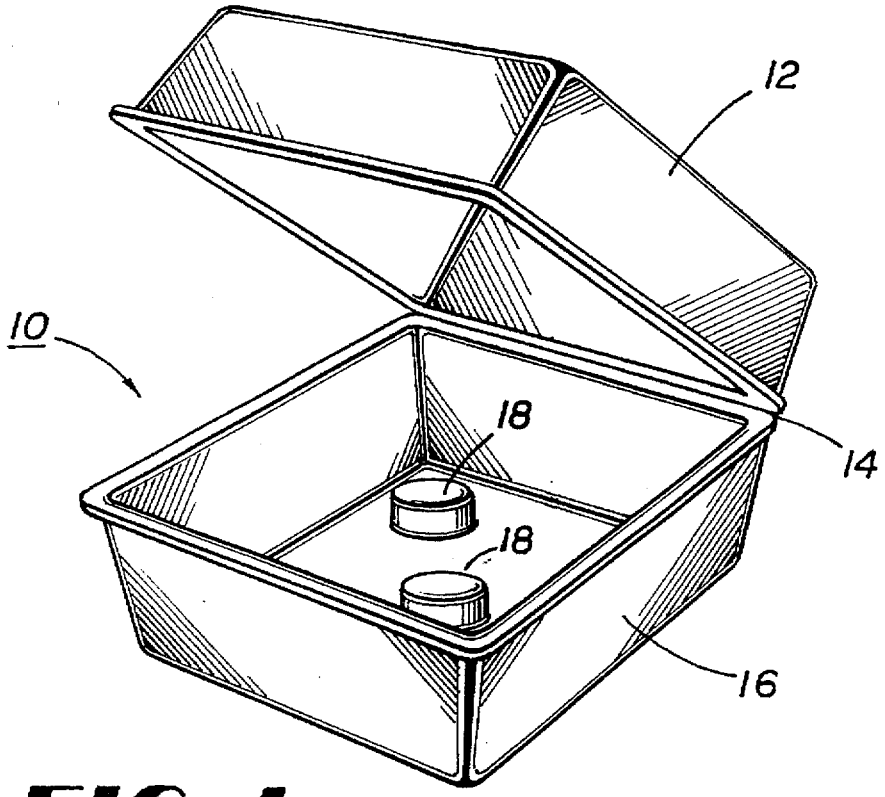
FIG. 1 is a perspective view illustrating a sandwich container for a hamburger or the like in accordance with the present invention shown in an open position to illustrate the internal features thereof.
Figure 2:
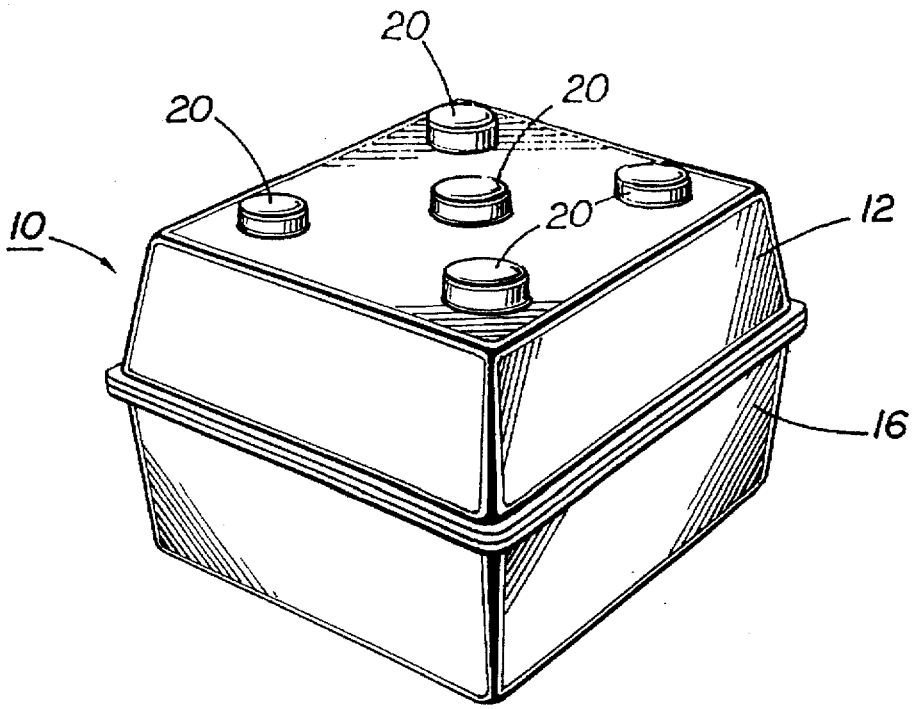
FIG. 2 is a perspective view illustrating the sandwich container of FIG. 1 in a closed condition illustrating the external features thereof.

Referring collectively to FIGS. 1 and 2, there is generally indicated a container (10) for sandwiches or the like including a lid (12) hinged at (14) by a living hinge in a known manner to a base section (16). Container (10) may be used for hamburgers and other sandwiches as well as salads, potatoes, breakfast foods, or the like. Such containers, with the exception of the projections (20) and sockets (18), are commonly available in fast-food restaurants.

Projections (20) are provided on the lid (12) of container (10) and sockets (18) are provided on the underside of base (16). As illustrated in FIG. 1, it can be seen that the sockets (18) project into the inside of the bottom wall of base (16).

The projections (20) are dimensioned so that each will fit into the sockets (18) with a reasonably snug fit to create a coupling action between respective plural containers of the type of FIGS. 1 and 2.

Figure 3:
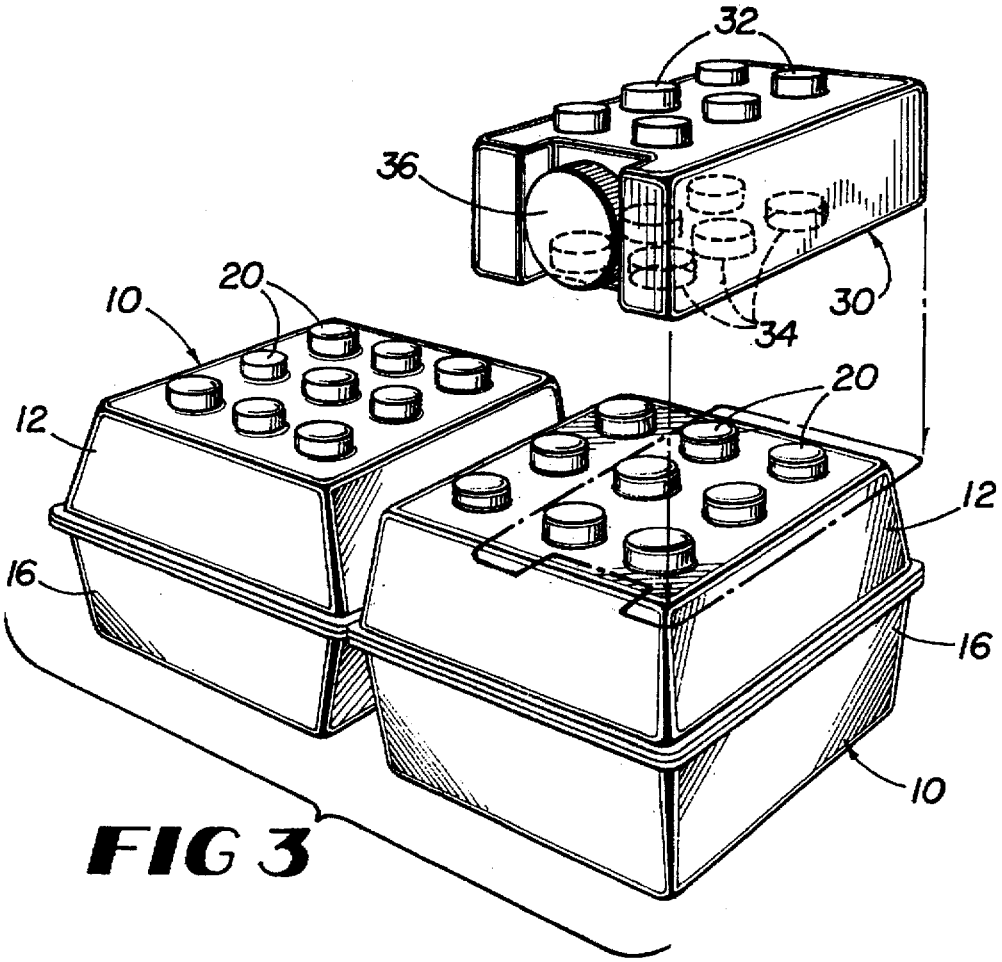
FIG. 3 is an exploded view illustrating one way in which the sandwich containers, generally similar to those of FIG. 1 but having different projection/socket configurations, can be coupled to a diverse-type of container for a beverage such as types similar to those illustrated in FIGS. 8, 11, 12 and 13.

FIG. 3 illustrates the manner in which a plurality of sandwich containers (10) may be coupled to a diverse type of food container (30) which contains a beverage to be served with a sandwich or other food products contained within containers (10). In the illustration of FIG. 3 beverage container (30) is simply coupled to one of the containers (10) by inserting equi-distant projections (20) from two containers (10) into sockets 34 in the underside of container (30). Of course, any number of additional containers (30) may be added to the configuration in order to create various shapes of toy-like appearance.

Figure 4:
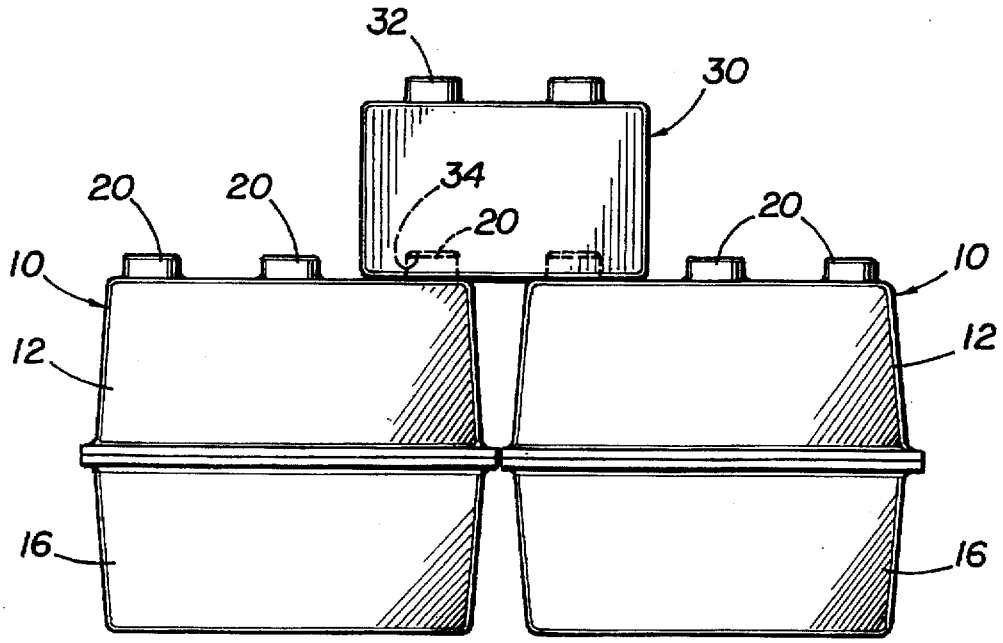
FIG. 4 is an elevational view illustrating another manner in which plural sandwich containers may be coupled to a beverage container which bridges the two sandwich containers.

In FIG. 4, the single beverage container (30) is illustrated as bridging two sandwich containers (10) and coupling the same together; but as in the illustration of FIG. 4, the illustration of only three containers is merely exemplary, it being understood that many other containers may be coupled together in various manners in order to form a creative toy-like device.

Figure 5:
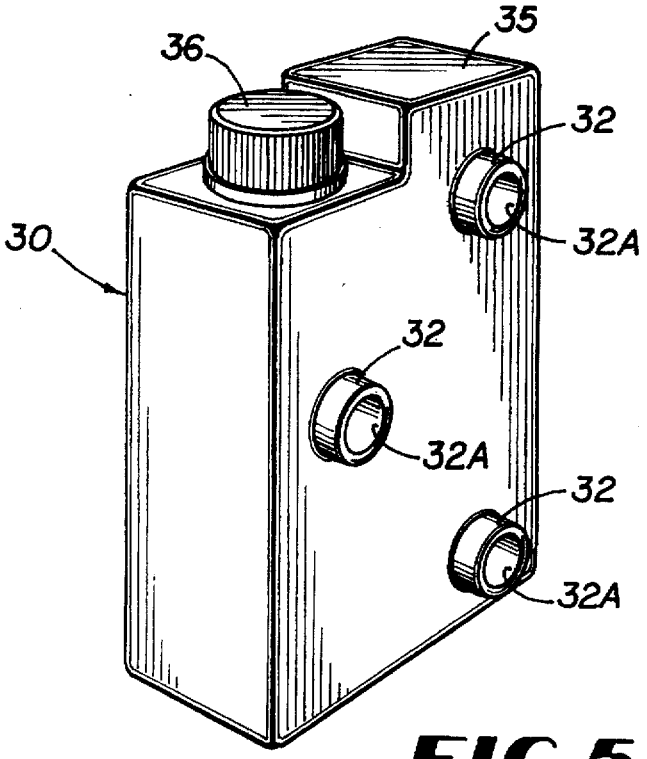
FIG. 5 is a perspective view of an embodiment of a container for serving a drink or beverage in accordance with the present invention.
Figure 6:
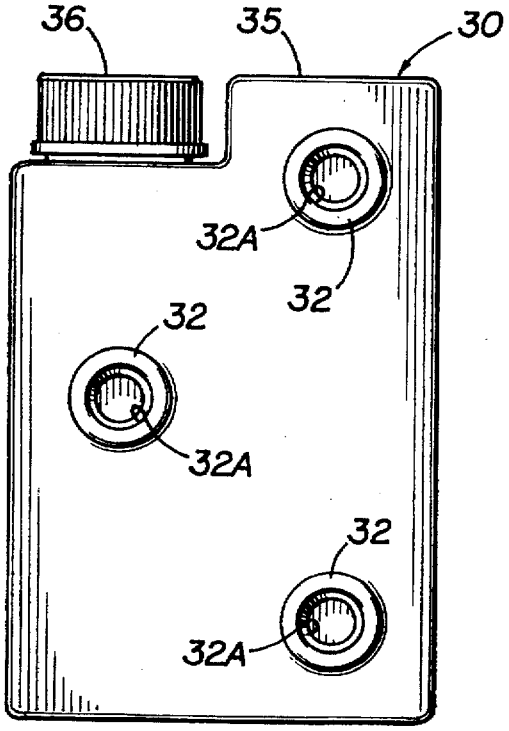
FIG. 6 is a front elevational view of the container of FIG. 5.
Figure 7:
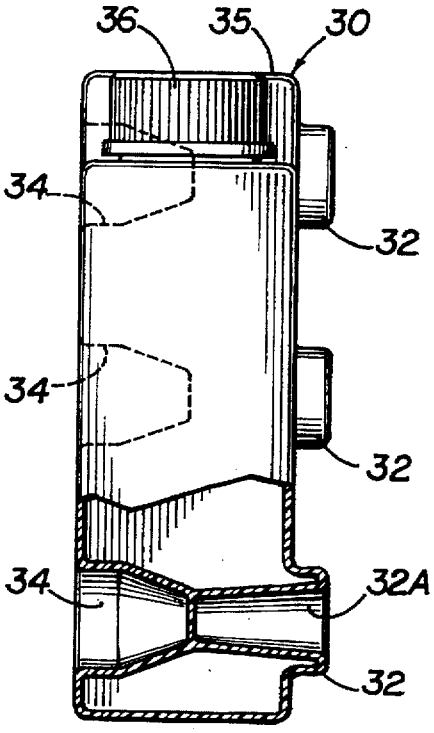
FIG. 7 is a left side elevational view partly in section of the container of FIG. 5 which illustrates details of the coupling projections and sockets of the present invention.

Referring to FIGS. 5 to 7, there is illustrated further details of the beverage or drink container (30) illustrated in FIGS. 3 and 4. For example, projections (32) may include hollow sockets (32A) therein which are sized, for example, to receive the projections (20) from diverse-type sandwich container (10). This construction also enhances package rigidity. Note for example in FIG. 7 that the sidewalls of socket 32A are connected through container 30 with the sidewalls of socket 34, providing increased strength to container 30. Also cylindrical projections (32) can serve as both projections for insertion into sockets of similar size in other containers and as sockets for receiving projections sized similar to sockets (32A) from other containers. Therefore, this projection/socket construction provides great flexibility in the possibilities of assembly to additional containers forming part of an overall food-service kit.

Container (30) has a stepped top wall including a step (35). A screw-on cap (36) attaches to an opening defined by a cylindrical neck with a finish (not shown). The top of cap (36) is flush with top of step (35) presenting planar surfaces which may be butted together in a desired building block configuration.

FIG. 7 illustrates that each of the respective projections (32) and accompanying sockets (32A) therein are disposed on a wall in direct opposition to sockets (34) on an opposite wall and are connected to each other as described above. In other words, the socket configuration (34) is substantially the same as the projection configuration (32). Of course, other possibilities exist without departing from the spirit and scope of the present invention.

Figure 8:
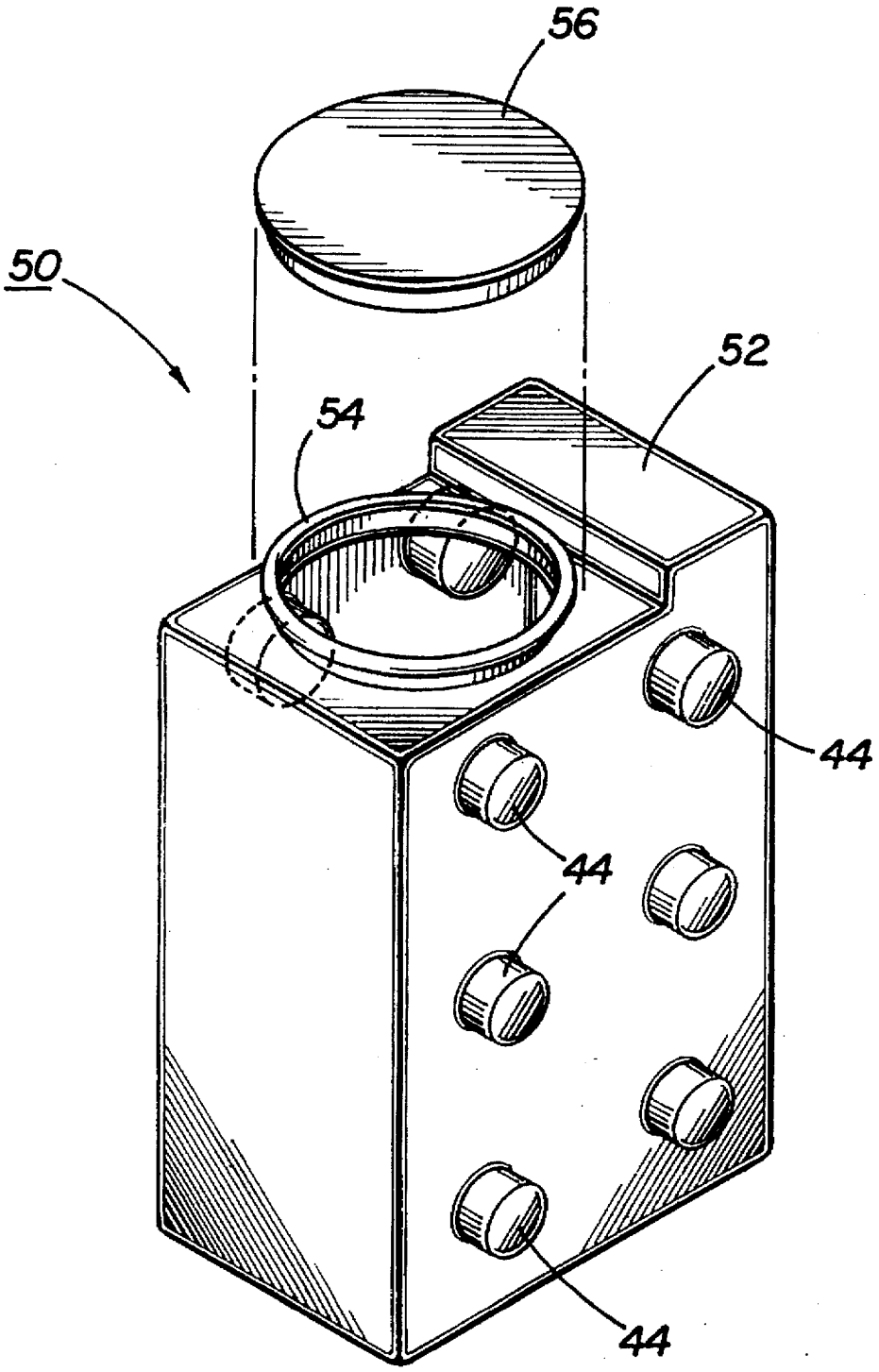
FIG. 8 is a perspective view of an alternative embodiment of a container for serving.

FIG. 8 illustrates another embodiment of a beverage container (50) for use with the present invention. The neck (54) of this container, which defines the discharge opening, has a much lower profile than in the FIG. 5 embodiment. The cap (56) is a snap-on cap also with a low profile. Step (52) is also lower than in FIG. 5 but is of the same height as neck (54) with a cap (56) thereon, in order to collectively provide a planar end surface. Preferably the cap and neck are of the same color as the surrounding portions of the container in order to minimize the visibility of the cap and neck when plural container ends are butted together.

Figure 9:
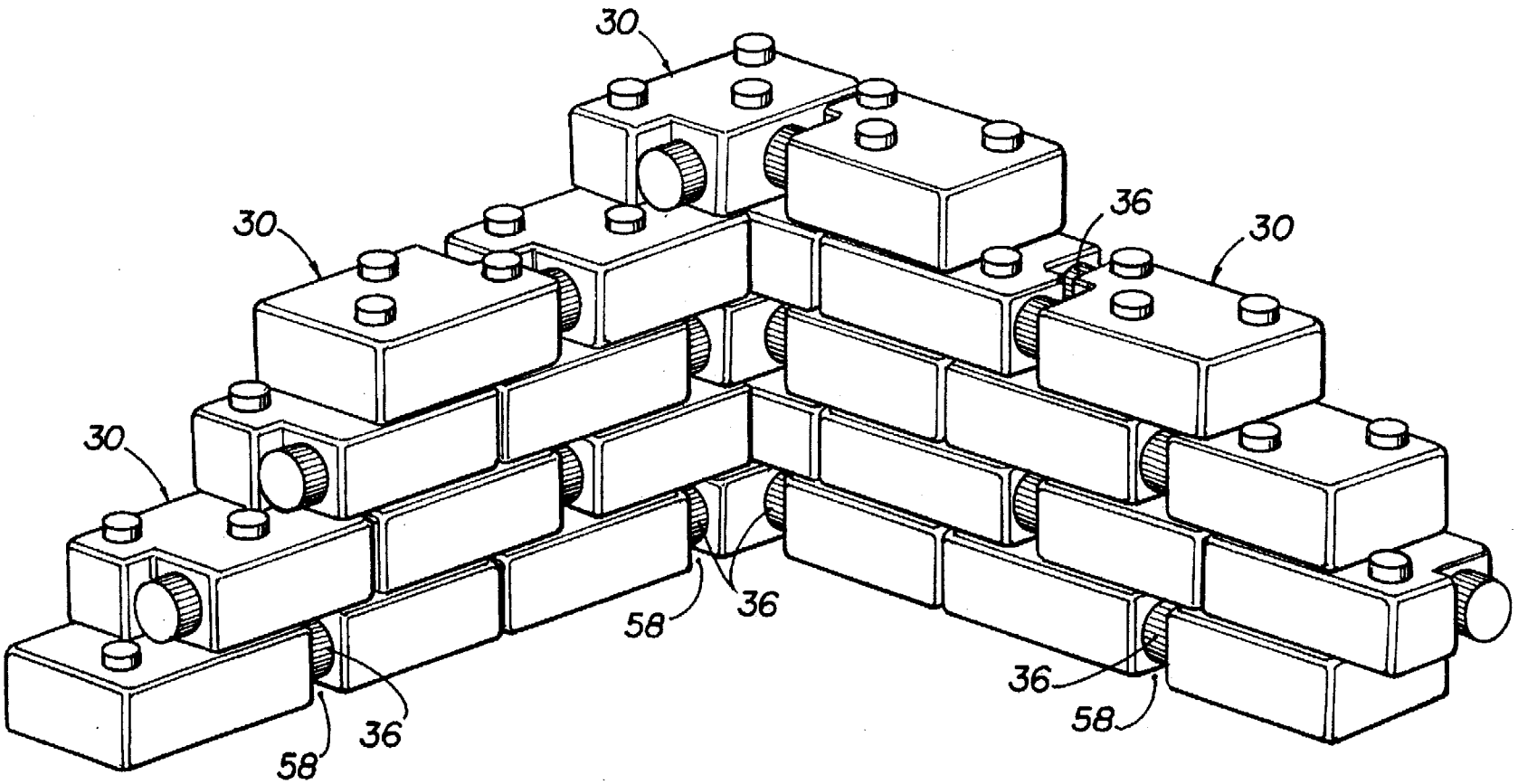
FIG. 9 is a perspective view of two abutting walls of a building assembled from plural containers of the type illustrated in FIGS. 5 to 7.

In the perspective view of FIG. 9 a plurality of containers (30) of FIG. 5 are illustrated in two abutting wall assemblies. The stepped ends of some adjacent blocks, and the associated caps (36) are butted together. But caps (36) remain quite visible, and because of the size thereof, create gaps in the wall assemblies.

Figure 13:
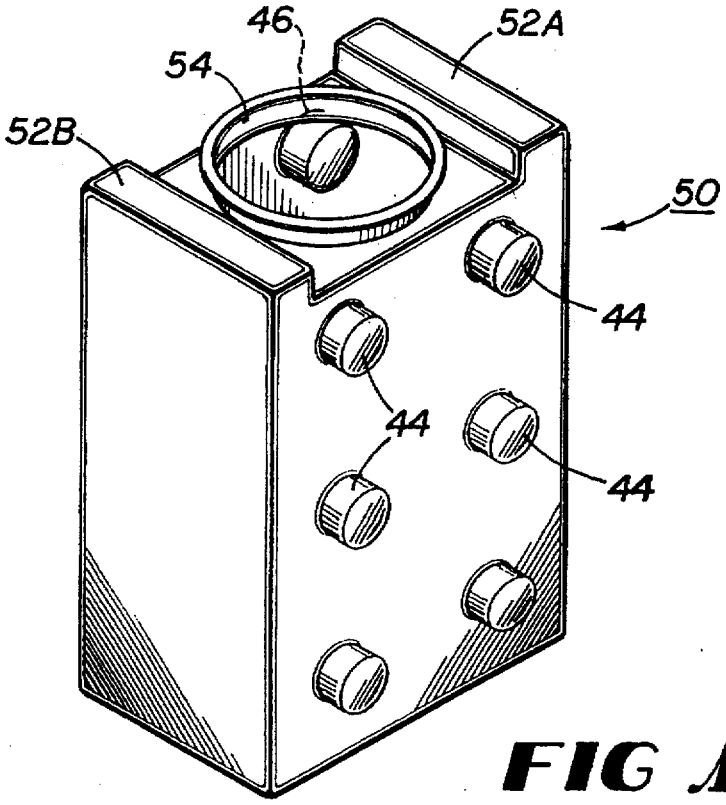
FIG. 13 is a perspective view of a third embodiment of a beverage container.

The illustration of FIG. (10) using the containers (50) demonstrates the improvement provided by low profile necks, caps and steps somewhat similar to those in either FIGS. 8 or 13. Note how the gaps (58) between capped container ends are much smaller and less visible than in FIG. 9. If the FIG. 13 containers are used, gaps 58 are eliminated. This results in an aesthetically pleasing wall assembly such as for the toy fort illustrated.

Figure 11:
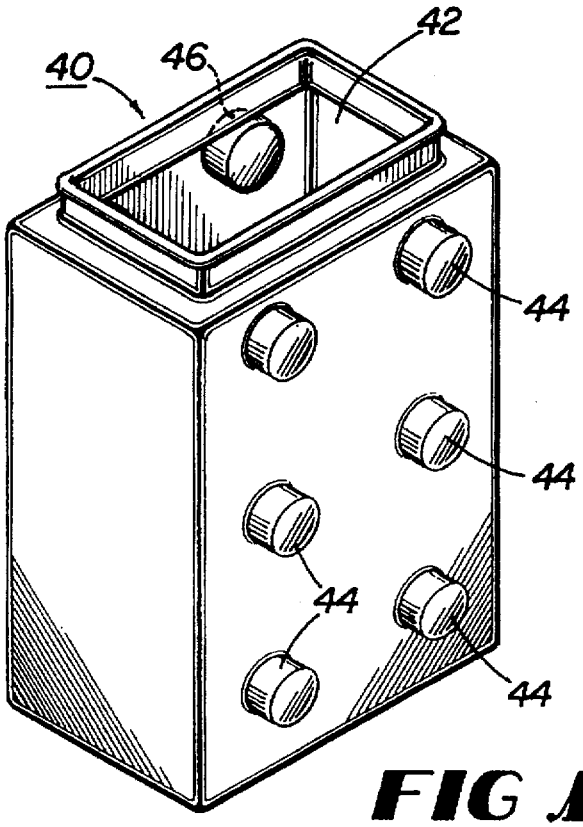
FIG. 11 is a perspective view of a container for french fried potatoes or the like which may be coupled in various ways to the containers of FIGS. 8, 12 and 13 to create toy-like assemblies.
Figure 12:
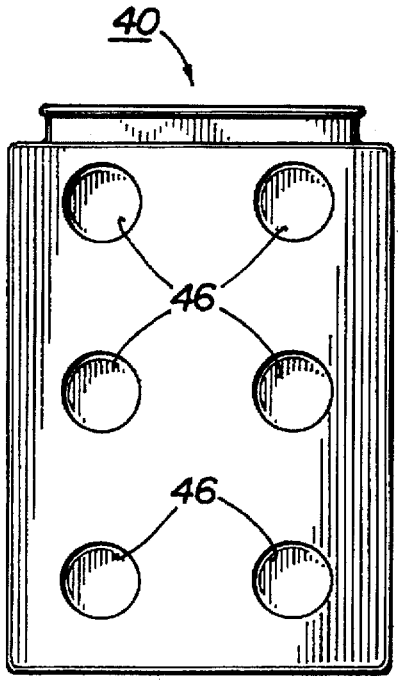
FIG. 12 is a rear elevational view of the container of FIG. 11.

Referring to FIGS. 11 and 12, there is illustrated another form of container (40) which is an open top rectangular-shaped container for accommodating for example french fried potatoes. The potatoes would protrude through the top opening (42) when the container (40) is initially filled. Container (40) includes a plurality of projections (44) on a front wall thereof and a plurality of sockets in a like configuration on the rear wall (46) as illustrated in FIG. 12. Of course, other configurations of projections and sockets are possible and the number of projections and sockets may vary in each configuration.

Figure 10:
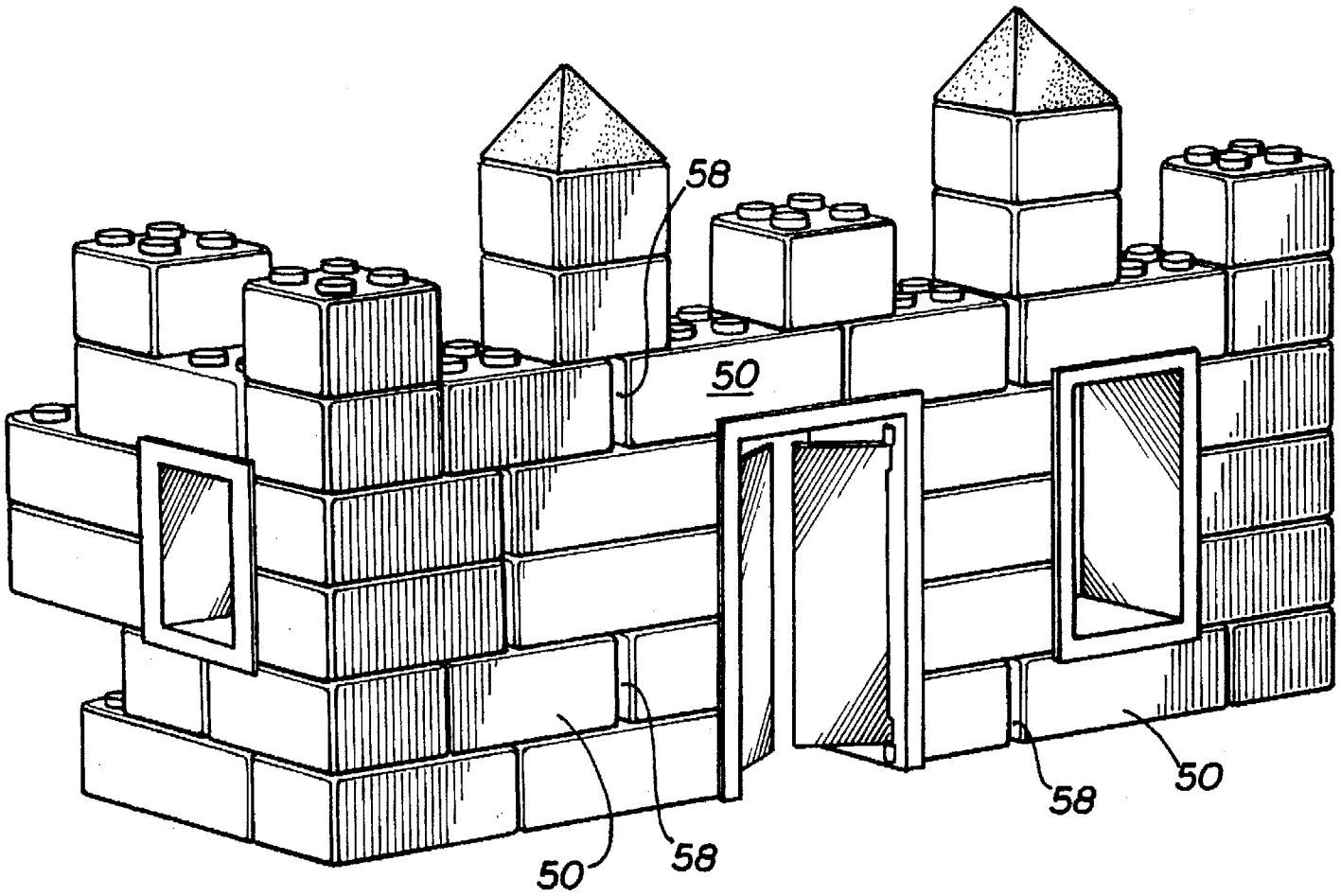
FIG. 10 is a front perspective view of a toy fort built from a plurality of containers.

FIG. 13 is a perspective view illustrating a third embodiment of a beverage container for use as a building block in accordance with the present invention. In this embodiment a pair of spaced steps (52A) and (52B) are disposed on the top of the container (50) and the container opening defined by neck (54) is disposed therebetween. This embodiment has the advantage that when assembled in a wall construction such as illustrated in FIGS. 9 and 10, there will be no gap between adjacent blocks when they are abutted together and the neck (54) and associated cap will not show.

Figure 14:
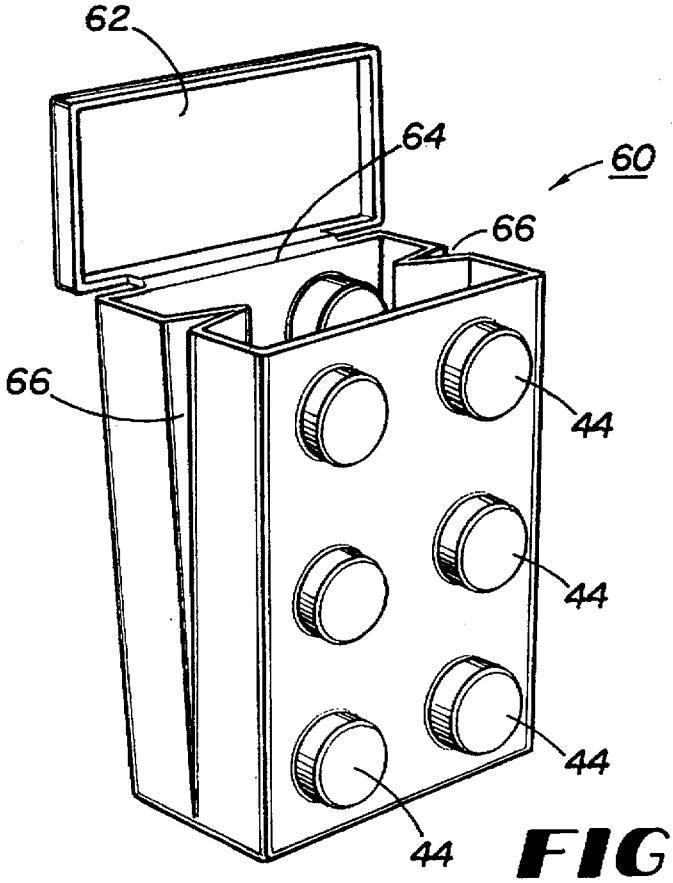
FIG. 14 is a perspective view of a fourth embodiment of a drink container illustrating a first, building block, shape thereof.
Figure 15:
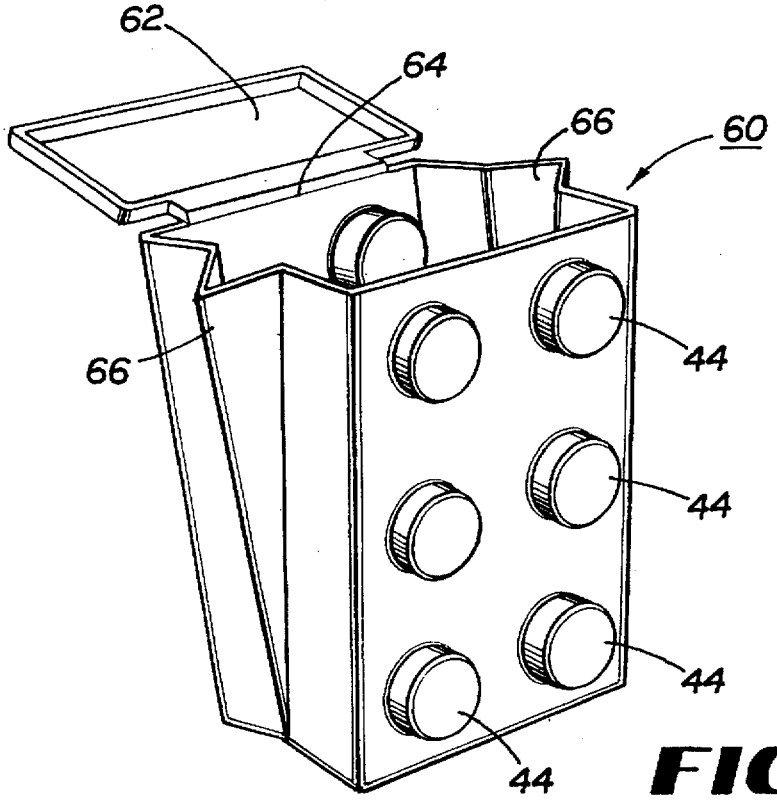
FIG. 15 illustrates a, second, nestable shape of the container of FIG. 14.

FIGS. 14 and 15 illustrate two respective shapes of a fourth embodiment of a beverage container for use with the present invention. The shape illustrated in FIG. 14 is a box-like shape of the container generally indicated (60). The container (60) will hold this shape as long as the lid (62) is flipped to a closed position about living hinge (64). Thus with the lid (62) closed on a container (60), the overall configuration is a box-like building block as in the other embodiments of the containers of the present invention.

Each side of container (60) is provided with pleats (66) which enable the container to expand or contract. As illustrated in FIG. 15, the container (60) may be expanded to the shape illustrated therein which is more funnel shaped. Since pleats 66 fold outwardly each may also function as pouring spouts. One major face of the container (60) is provided with projections (44) and an opposing major face is provided with sockets (46) (not shown) of a similar configuration in the same manner as the other containers of the present invention.

While in the position illustrated in FIG. 15, it can be seen that a plurality of empty containers with the lids (62) flipped back may be nested or stacked either before or after use. This is a space-saver and a very important aspect of this embodiment of the present invention.

The lid (62) in FIGS. 14 and 15 is shown as being substantially flat with a flange about its periphery for engagement with the side walls of the body of the container (60). However, the lid may also be provided with a drinking spout and/or a straw hole if desired.

It is within the scope of the present invention to combine any of the containers disclosed herein into building block assemblies; and/or to combine any containers disclosed herein with any containers disclosed in parent application Ser. No. 29/027,425, filed Aug. 22, 1994.

It can been seen that the food service kit of the present invention has great entertainment value especially for young children in fast-food restaurants. A typical meal in a fast-food restaurant would include a beverage, a hamburger, and an order of fries; and with the food service kit of the present invention, a child could create toy-like assemblies using the containers as building blocks after the food in the containers is consumed. This could be of great benefit to parents in keeping their children occupied. Furthermore, it provides an incentive to purchase more food or beverages in order to provide the customer with greater possibilities of creating larger varieties of toy-like assemblies.

It should be understood that the food service kit of the present invention may be modified in many ways as would occur to one ordinarily skilled in the art without departing from the spirit and scope of the present invention.

What is claimed is:

1. A food service kit comprising:

at least two diverse types of food containers for serving diverse food products; and each of said at least two containers having like configurations of projections extending therefrom and like configurations of sockets for coupling with the projections of the other of the diverse types of containers;

one of the at least two containers including a neck surrounding and defining a discharge opening for serving a beverage and the other of said containers is for serving a sandwich, the container having a neck further includes a removable cap thereon and a recess in a stepped wall of the container for accommodating the neck and cap, the stepped wall having an upper surface and when mounted on the neck, a top of the cap being flush with the upper surface of the stepped wall; and whereby the diverse types of food containers may be coupled together as building blocks to create toy-like assemblies.

2. The food service kit of claim 1, wherein the upper surface of the stepped wall is generally flat.

3. The food service kit of claim 1, wherein the cap is readily removable from the neck of the container.

4. The food service kit of claim 1, wherein the recess in the container having a neck is between two spaced steps and at least one of the steps having the upper surface which is flush with the top of the cap when the cap is mounted on the neck of the container.

5. The food service kit of claim 4, wherein both of the spaced steps have a generally flat upper surface which is flush with the top of the cap when the cap is mounted on the neck of the container.

6. The food service kit of claim 1, wherein the cap is fastened to the neck by screw threads.

7. The food service kit of claim 1, wherein the cap is a relatively low profile snap-on cap.

8. The food service kit of claim 1, further including a container for serving potatoes.

9. The food service kit of claim 1, wherein the neck and cap are substantially the same color as surrounding container portions.

10. The food service kit of claim 1, wherein the like configurations of sockets in at least one of the containers are provided on two opposing walls of the container and wherein sidewalls of some of the sockets on opposing walls of the same container engage one another through an interior of the container.

11. The food service kit of claim 1, wherein said projections are hollow and form additional sockets for receiving projections of like size from other containers.

12. The food service kit of claim 1, wherein one of the containers is an expandable container with a body portion having an opening therein, said body portion being expandable between a box-like shape in a first position and a funnel-shape in a second position, a plurality of like ones of the containers being nestable within each other when in the funnel-shape.

13. The food service kit of claim 12, wherein the expandable container has a lid and engageable with the body portion about the opening when the lid is in a closed position, said lid holding said body portion in the box-like shape while in the closed position and permitting the body portion to expand to the funnel-shape while the lid is in an open position.

14. The food service kit of claim 13, wherein the lid is hinged to the body portion adjacent the opening.

15. The food service kit of claim 14, wherein the body portion has pleats to facilitate the expansion between the first and second positions.

16. The food service kit of claim 12, wherein the body portion has pleats to facilitate the expansion between the first and second positions.

17. The food service kit of claim 16, wherein at least one of said pleats when expanded to the second position projects outwardly in the provision of a pouring spout.

* * * * *